US011897646B2

(12) United States Patent
Kawai et al.

(10) Patent No.: US 11,897,646 B2
(45) Date of Patent: Feb. 13, 2024

(54) BLISTER PACKAGING MACHINE AND METHOD FOR MANUFACTURING BLISTER PACK

(71) Applicant: CKD CORPORATION, Aichi (JP)

(72) Inventors: Seiji Kawai, Aichi (JP); Tomomi Kikukawa, Aichi (JP); Satoshi Watanabe, Aichi (JP)

(73) Assignee: CKD CORPORATION, Aichi (JP)

( * ) Notice: Subject to any disclaimer, the term of this patent is extended or adjusted under 35 U.S.C. 154(b) by 456 days.

(21) Appl. No.: 17/243,765

(22) Filed: Apr. 29, 2021

(65) Prior Publication Data

US 2021/0245909 A1 Aug. 12, 2021

Related U.S. Application Data

(63) Continuation of application No. PCT/JP2019/036036, filed on Sep. 13, 2019.

(30) Foreign Application Priority Data

Nov. 19, 2018 (JP) ..... 2018-216171

(51) Int. Cl.
*B65B 47/02* (2006.01)
*B65B 9/04* (2006.01)
(Continued)

(52) U.S. Cl.
CPC ..... *B65B 47/02* (2013.01); *B65B 9/045* (2013.01); *B65B 41/16* (2013.01); *B65B 47/04* (2013.01)

(58) Field of Classification Search
CPC ..... B65B 9/04; B65B 47/04; B65B 9/045; B65B 11/52; B65B 47/02; B65B 61/06;
(Continued)

(56) References Cited

U.S. PATENT DOCUMENTS

2003/0051443 A1* 3/2003 Kodai ..... B29C 51/428 53/559
2022/0135262 A1* 5/2022 Watanabe ..... B65B 61/065 53/453

FOREIGN PATENT DOCUMENTS

JP 2004269004 A * 9/2004 ..... B29C 51/08
JP 2018-86706 A 6/2018
JP 2018086706 A * 6/2018 ..... B26D 1/24

OTHER PUBLICATIONS

International Preliminary Report on Patentability issued for PCT/JP2019/036036, dated May 25, 2021 (11 pages).
(Continued)

*Primary Examiner* — Jacob A Smith
(74) *Attorney, Agent, or Firm* — Osha Bergman Watanabe & Burton LLP

(57) ABSTRACT

A blister packaging machine manufactures a blister pack including a pocket portion formed in a container film of a belt-like shape and a cover film that closes the pocket portion. The blister packaging machine includes: a conveyor that conveys the container film; a preheater that preheats the container film conveyed by the conveyor; a pocket portion former that forms the pocket portion in the container film softened by the preheater; and a support belt that moves in synchronism with the container film conveyed by the conveyor while supporting a part of the container film other than the pocket portion or a part of the container film other than an area where the pocket portion is to be formed, in at least a location from the preheater to a position downstream of the pocket portion former.

21 Claims, 7 Drawing Sheets

(51) Int. Cl.
*B65B 41/16* (2006.01)
*B65B 47/04* (2006.01)

(58) Field of Classification Search
CPC ..... B65B 11/50; B65B 41/00; B65B 41/12; B65B 41/14; B65B 41/16
USPC ..... 53/284.5, 452, 453, 559, 561
See application file for complete search history.

(56) References Cited

OTHER PUBLICATIONS

Written Opinion of the International Searching Authority issued in corresponding International Application No. PCT/JP2019/036036 dated Dec. 17, 2019 (3 pages).
International Search Report issued in corresponding International Application No. PCT/JP2019/036036 dated Dec. 17, 2019 (3 pages).

* cited by examiner

BLISTER PACKAGING MACHINE AND METHOD FOR MANUFACTURING BLISTER PACK

BACKGROUND

Technical Field

The present disclosure relates to a blister packaging machine configured to manufacture a blister pack with a predetermined content placed therein, and a method of manufacturing the blister pack.

Description of Related Art

A blister pack includes a container film provided with a pocket portion which any of various contents is placed in, and a cover film mounted to the container film such as to seal an opening side of the pocket portion.

The blister pack is manufactured by a blister packaging machine provided with, for example, a conveying unit, a preheating unit, a pocket portion forming unit, a filling unit, a sealing unit and a punching unit (as described in, for example, Patent Literature 1). A procedure of manufacturing the blister pack conveys a container film in a belt-like form by the conveying unit (for example, a clip chain conveyor) to the preheating unit, the pocket portion forming unit, the filling unit, the sealing unit and the punching unit in this sequence and causes the respective units to sequentially process the container film by predetermined processes, so as to manufacture the blister pack. The preheating unit preheats the container film to soften the container film. The pocket portion forming unit forms a pocket portion in the softened container film by, for example, a pressure forming method. The filling unit fills the pocket portion thus formed with a content. The sealing unit mounts the cover film to the container film, so as to seal an opening side of the pocket portion filled with the content. The punching unit punches a blister film obtained by mounting the cover film to the container film. A blister pack is punched out from the blister film.

A product with a sealed content may be subjected to retort sterilization (pressurized heating) for the purpose of sterilization and long-term preservation of the content. A procedure of retort sterilization places the product in a retort oven and heats the product at a high temperature of not lower than 100° C. under a pressurized condition. The blister pack may be subjected to such retort sterilization in the case that the content of the blister pack is a food item or the like.

PATENT LITERATURE

Patent Literature 1: JP 2018-86706A

Heat treatment such as retort sterilization of the blister pack is, however, likely to cause shrinkage deformation in the blister pack or especially in the container film by heating in the course of heat treatment. With a view to preventing shrinkage deformation, one possible measure sets the preheating temperature of the container film by the preheating unit to a high temperature (for example, a melting point of the container film or higher). The high preheating temperature of the container film is, however, likely to cause the container film after preheating to significantly sag (slack) by its own weight. In the case where the container film is significantly sagged, a sagged part of the container film is likely to come into contact with a device involved in manufacture, for example, the pocket portion forming unit and interfere with the manufacture of the blister pack or is likely to cause a varying thickness or crease in the pocket portion and lower the quality of the blister pack.

SUMMARY

By taking into account the circumstances described above, one or more embodiments of the present disclosure provide a blister packaging machine used to manufacture a blister pack that is subjected to heat treatment such as retort sterilization after manufacture and a method of manufacturing such a blister pack and more specifically to provide a blister packaging machine that prevents the occurrent of a trouble caused by a sag or the like of a container film and a method of manufacturing such a blister pack.

The following describes embodiments of the present disclosure. Functions and advantageous effects that are characteristic of one or more embodiments are also described as appropriate.

One or more embodiments provide a blister packaging machine used to manufacture a blister pack configured such that a content is placed in a pocket portion formed in a container film and that a cover film is mounted to the container film such as to close the pocket portion. The blister packaging machine comprises a conveying unit (i.e., conveyor) configured to convey the container film in a belt-like form; a preheating unit (i.e., preheater) configured to preheat the container film that is conveyed; a pocket portion forming unit (i.e., pocket portion former) configured to form the pocket portion in the container film that is softened by the preheating unit; and a support belt configured to move in synchronism with the container film conveyed by the conveying unit, while supporting part of the container film other than the pocket portion or part of the container film other than a pocket portion-forming area where the pocket portion is to be formed, in at least a location from the preheating unit to a position downstream of the pocket portion forming unit.

The support of the container film by the support belt may be started at a position upstream of the preheating unit. In the case of stepwise preheating by the preheating unit, the support of the container film by the support belt may be started at a stage in the middle of preheating.

The configuration of one or more embodiments causes the support belt to be moved in synchronism with the container film that is conveyed. Accordingly, this configuration prevents a frictional force due to a difference between moving modes from being generated between the support belt and the container film. This configuration thus enables the container film to be supported with minimizing the load applied to the container film and thereby more reliably prevents the container film from being damaged or deformed.

Moreover, the configuration of one or more embodiments causes the container film to be supported by the support belt in a location from the preheating unit to a position downstream of the pocket portion forming unit, i.e., in a location where the container film is especially likely to sag by preheating. Even when the preheating temperature of the container film is a high temperature (for example, a melting point of the container film or higher) to be suitable for heat treatment such as retort sterilization, this configuration effectively suppresses the container film from sagging. Accordingly, this more reliably prevents the occurrence of a trouble caused by a significant sag of the container film.

Furthermore, the support belt serves to support part of the container film other than the pocket portion or part of the container film other than the pocket portion-forming area where the pocket portion is to be formed. More specifically, the support belt supports part of the container film other than the pocket portion-forming area where the pocket portion is to be formed in a stage prior to formation of the pocket portion and supports part of the container film other than the pocket portion in a stage after formation of the pocket portion. This configuration accordingly suppresses the support belt from affecting the shape of the pocket portion and thereby enhances the quality with regard to the pocket portion.

In the blister packaging machine described above, the pocket portion forming unit may include a lower mold configured to be moved up and down, and the lower mold may be provided with a receiving recess that is extended along a conveying direction of the container film. The support belt may be configured to be placed in the receiving recess in a state that the lower mold is moved up.

The configuration of one or more embodiments causes the support belt to be placed in the receiving recess provided in the lower mold, when the lower mold is moved up. This configuration accordingly enables the process of forming the pocket portion in the container film to be performed without being affected by the support belt and thereby further ensures the good quality of the pocket portion.

In the blister packaging machine described above, the pocket portion forming unit may include an upper mold placed above the lower mold, and the support belt may be configured to be brought into contact with the lower mold and to cause the container film to be placed between the support belt and the upper mold, in the state that the lower mold is moved up.

In the case where the container film is not sufficiently solidified when the support of the container film by the support belt is released (i.e., when the support belt is separated from the container film), the container film is likely to be pulled by the support belt and is thus likely to be damaged or deformed.

According to the configuration of one or more embodiments, on the other hand, when the lower mold is moved up, the support belt is brought into contact with the lower mold and causes the container film to be placed between the support belt and the upper mold. This configuration accordingly enables the heat of the support belt to be more reliably transferred to the lower mold and the upper mold and thereby efficiently cools down the support belt. This configuration thus enables the part of the container film supported by the support belt to be effectively cooled down and sufficiently solidified. Accordingly, this more reliably prevents the container film from being deformed or damaged in the event of release of the support of the container film by the support belt. As a result, this furthermore ensures the good quality of the blister pack.

In the blister packaging machine described above, the support belt may be configured to be moved along a retreat pathway that gradually becomes away from a conveyance path of the container film, downstream of the pocket portion forming unit. The blister packaging machine may further comprise a separation unit (i.e., separator) configured to be brought into contact with the part of the container film other than the pocket portion and thereby separate the container film from the support belt, when the support belt supporting the container film is moved along the retreat pathway.

The configuration of one or more embodiments causes the container film in the softened state to be supported by the support belt. Accordingly, at a stage when the support of the container film by the support belt is released (i.e., when the support belt is separated from the container film), the container film is likely to be stuck to the support belt.

According to the configuration of one or more embodiments, on the other hand, when the support belt is moved along the retreat pathway that gradually becomes away from the conveyance path of the container film, the container film supported by the support belt is brought into contact with the separation unit. This enables the container film to be more reliably separated from the support belt. This configuration also effectively prevent the container film from being deviated from its expected conveyance path and being excessively pulled toward the moving path of the support belt and thereby more reliably prevent the container film from being deformed or damaged.

In the blister packaging machine described above, the container film in the belt like form may have a plurality of the pocket portions formed along a width direction thereof.

The configuration of one or more embodiments uses the wide container film that enables a plurality of the pocket portions to be formed along the width direction. This enables the plurality of pocket portions to be formed simultaneously and enhances the production efficiency.

In the case of using the wide container film that enables a plurality of the pocket portions to be formed along the width direction, on the other hand, the container film is more likely to significantly sag by preheating. Employing the configuration of one or more embodiments, however, suppresses the container film from sagging. Accordingly, even in the case of using a wide container film, this configuration more reliably prevents the occurrence of a trouble caused by a sag of the container film. In other words, the configuration of one or more embodiments is especially effective in the case of using the wide container film that enables a plurality of the pocket portions to be formed along the width direction.

One or more embodiments provide a method of manufacturing a blister pack configured such that a content is placed in a pocket portion formed in a container film and that a cover film is mounted to the container film such as to close the pocket portion. The method of manufacturing the blister pack comprises: a conveying process of conveying the container film in a belt-like form; a preheating process of preheating the container film that is conveyed; a pocket portion forming process of forming the pocket portion in the container film that is softened in the preheating process; and a supporting process of supporting part of the container film other than the pocket portion or part of the container film other than a pocket portion-forming area where the pocket portion is to be formed, by using a support belt that is configured to move in synchronism with the conveyed container film, during at least an interval from the preheating process to completion of the pocket portion forming process.

The configuration of one or more embodiments has functions and advantageous effects similar to those described above.

In the method of manufacturing the blister pack described above, the pocket portion forming process may form the pocket portion in a state that a lower mold configured to be moved up and down and to have a receiving recess extended along a conveying direction of the container film is moved up to place the support belt in the receiving recess.

The configuration of one or more embodiments has functions and advantageous effects similar to those described above.

In the method of manufacturing the blister pack described above, the pocket portion forming process may cause the support belt to be brought into contact with the lower mold and may cause the container film to be placed between the support belt and an upper mold placed above the lower mold, in the state that the lower mold is moved up.

The configuration of one or more embodiments has functions and advantageous effects similar to those described above.

The method of manufacturing the blister pack described above may further comprise a separation process of moving the support belt that supports the container film to go along a retreat pathway that gradually becomes away from a conveyance path of the container film, after the pocket portion forming process, and bringing the part of the container film other than the pocket portion into contact with a predetermined separation unit (i.e., separator), so as to separate the container film from the support belt.

The configuration of one or more embodiments has functions and advantageous effects similar to those described above.

In the method of manufacturing the blister pack described above, the container film in the belt-like form may have a plurality of the pocket portions formed along a width direction thereof.

The configuration of one or more embodiments has functions and advantageous effects similar to those described above.

In the method of manufacturing the blister pack described above, the container film prior to preheating in the preheating process may have a thickness of not greater than 300 μm.

Like the above configuration, using the container film having the thickness of not greater than 300 μm prior to preheating reduces the material cost in manufacture of the blister pack. This configuration also enables the content to be heated more quickly and more reliably in a process of heat treatment such as retort sterilization of the blister pack.

In the case of using the container film that has the thickness of not greater than 300 μm, on the other hand, the container film is more likely to significantly sag by preheating. Employing the above configuration, however, suppresses the container film from sagging. Accordingly, even in the case of using a thin container film, this configuration more reliably prevents the occurrence of a trouble caused by a sag of the container film. In other words, the above configuration is especially effective in the case of using the container film that has the thickness of not greater than 300 μm.

DETAILED DESCRIPTION OF EMBODIMENTS

The following describes embodiments with reference to drawings. The configuration of a blister pack manufactured by a blister packaging machine of one or more embodiments is described first.

Figure 1:
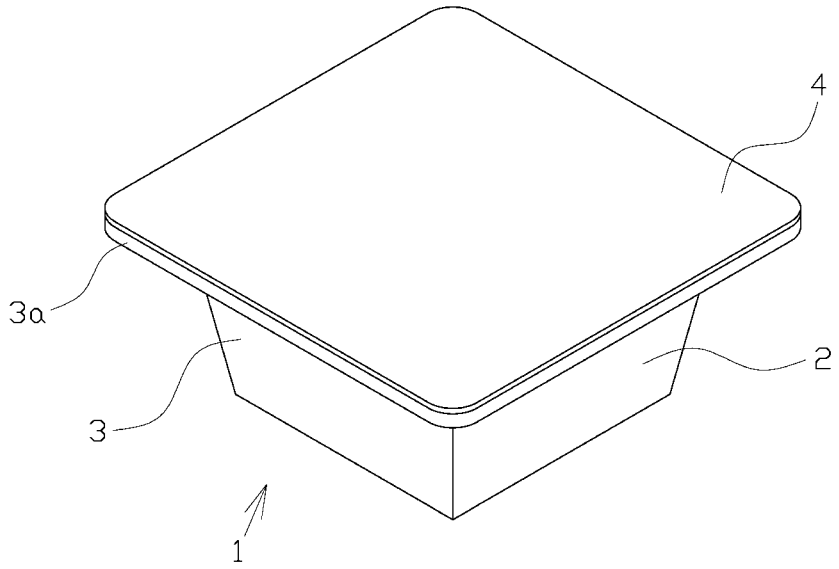
FIG. 1 is a perspective view illustrating a blister pack.
Figure 2:
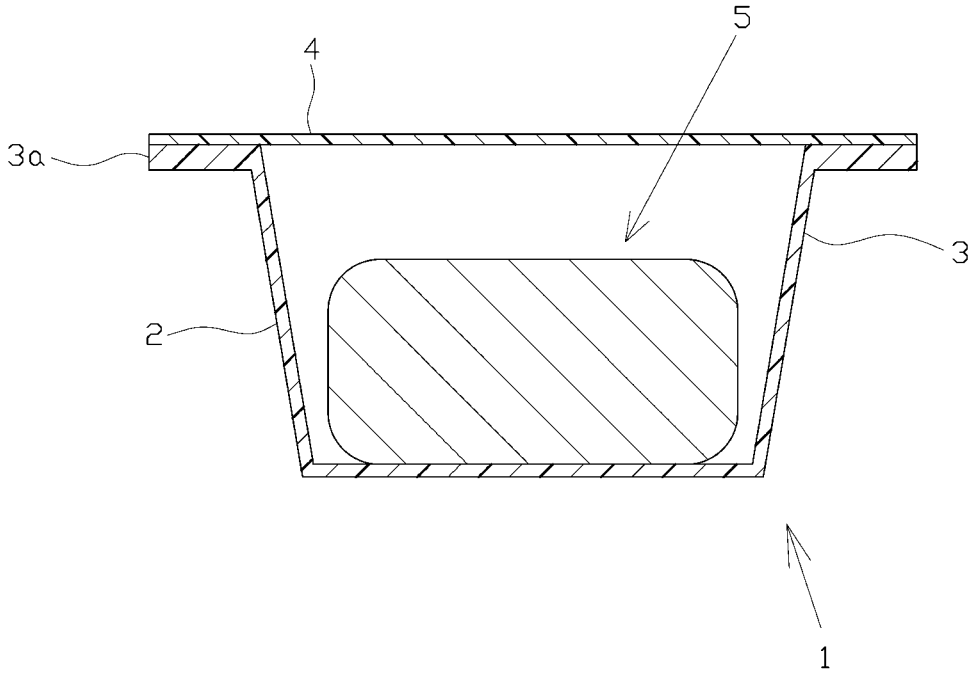
FIG. 2 is a sectional view illustrating the blister pack.

As shown in FIG. 1 and FIG. 2, a blister pack 1 according to one or more embodiments includes a container film 3 having one pocket portion 2, and a cover film 4 mounted to the container film 3 such as to close the pocket portion 2. The films 3 and 4 shown in, for example, FIG. 1 are illustrated to be thicker than actual thicknesses thereof. A content 5 such as a food product or a pet food is placed in the pocket portion 2. The container film 3 and the cover film 4 practically have no gas permeability to keep the content 5 in a sealed state.

The container film 3 is made of a thermoplastic resin material, such as PP (polypropylene) or the like. The container film 3 may have a multi-layered structure made of multiple different types of thermoplastic resin materials. The container film 3 has a flange portion 3*a* formed to be extended outward from a periphery of an opening of the pocket portion 2. The cover film 4 is, on the other hand, made of a thermoplastic resin compatible with the container film 3 and is mounted to the flange portion 3*a* of the container film 3 described above. The cover film 4 may be configured by a heat-resistant thin wall member with a sealant that is applied on the surface thereof and that is made of a thermoplastic resin compatible with the container film 3.

The blister pack 1 is subjected to heat treatment such as retort sterilization with a view to sterilizing the content 5. The heat treatment of the blister pack 1 is performed by heating the blister pack 1 at a high temperature of not lower than 100° C. (for example, 120° C. or higher) under a pressurized condition.

Figure 11:
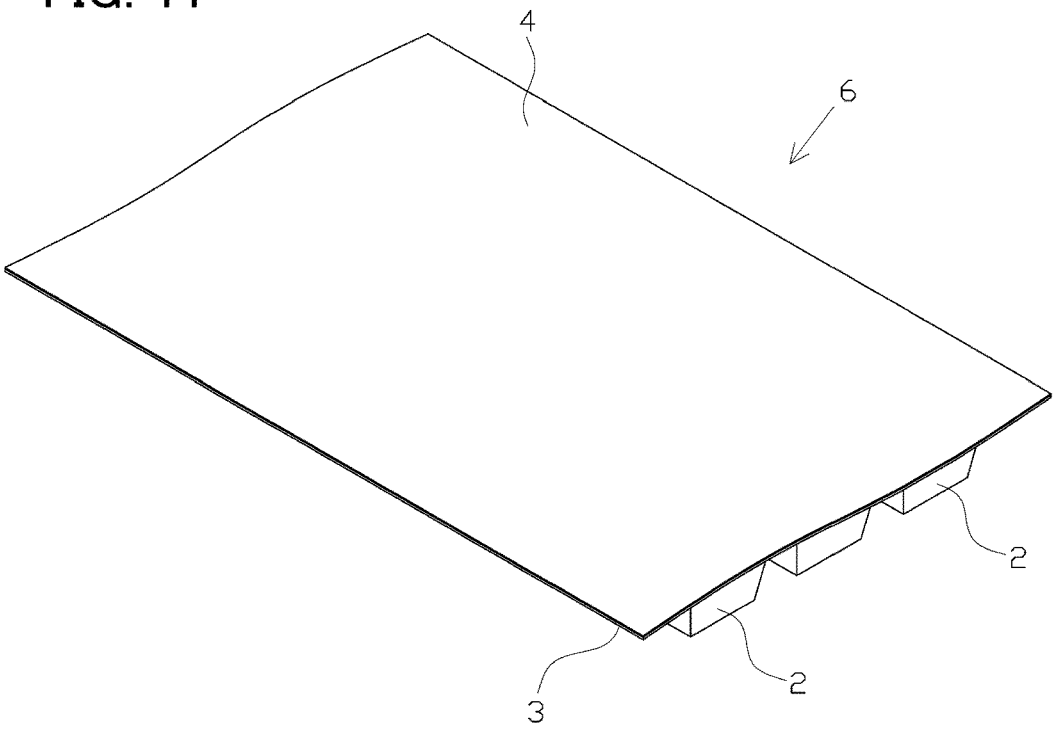
FIG. 11 is a perspective view illustrating a blister film.

Furthermore, the blister pack 1 is obtained by being punched out from a belt-like blister film 6 (as shown in FIG. 11) that is formed by mounting the cover film 4 in a belt-like form to the container film 3 in a belt-like form. The blister film 6 of one or more embodiments is configured such that three blister packs 1 are arrayed along a width direction of the blister film 6.

The following describes the configuration of a blister packaging machine 10 to manufacture the blister packs 1 described above.

Figure 3:
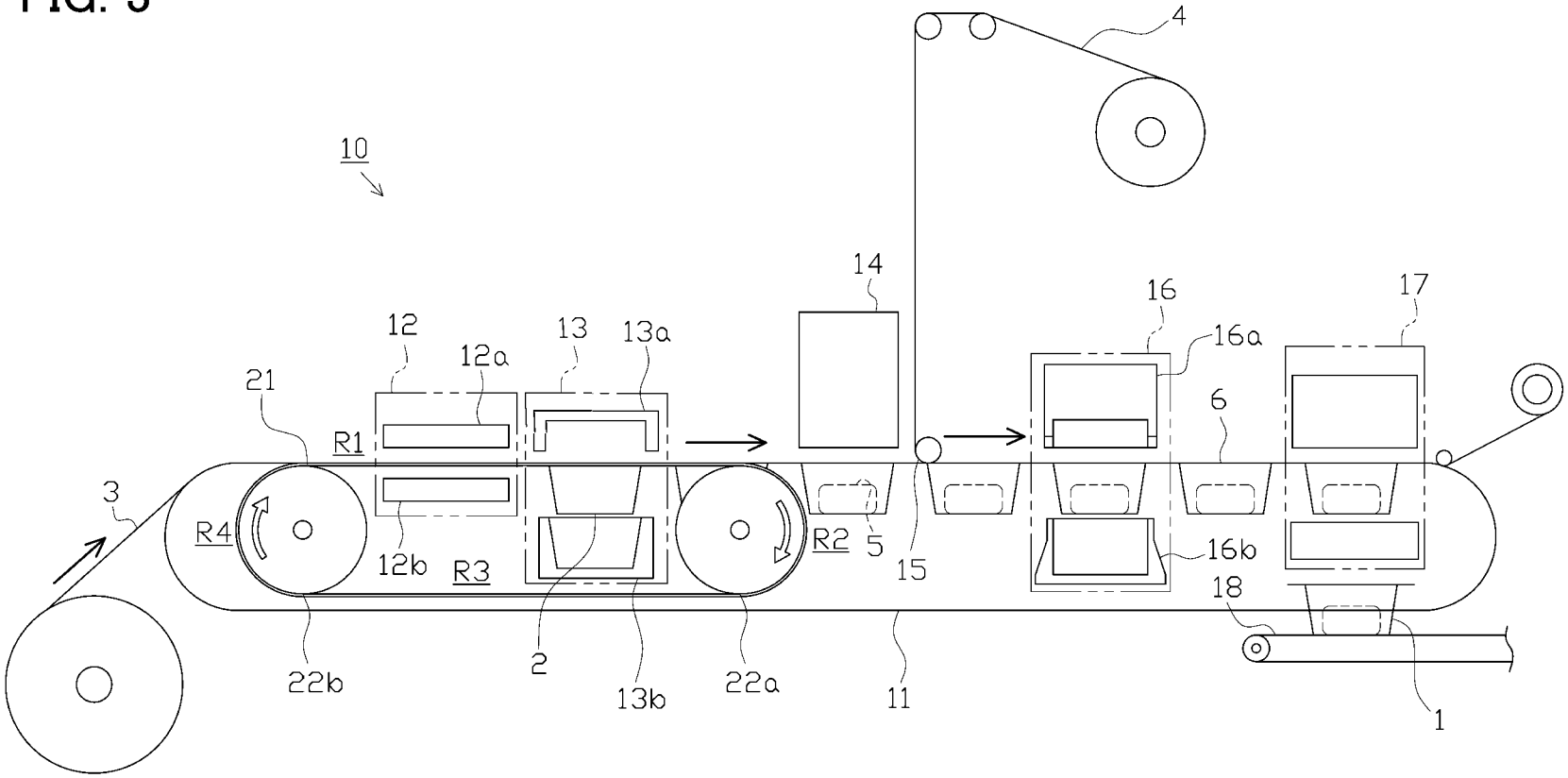
FIG. 3 is a schematic diagram illustrating schematic configuration of a blister packaging machine.

As shown in FIG. 3, in the blister packaging machine 10, the belt-like container film 3 pulled out from a film roll is intermittently conveyed toward a downstream side by a clip chain conveyor 11 serving as the conveying unit. A clipping portion 11*a* (as shown in, for example, FIGS. 4 and 5) of the clip chain conveyor 11 holds respective ends in a width direction of the container film 3 (part that is eventually regarded as scrap).

The belt-like container film 3 pulled out from the film roll is relatively wide and is configured to enable a plurality of (three according to one or more embodiments) pocket portions 2 to be formed along the width direction thereof. The container film 3 pulled out from the film roll is relatively thin and has a thickness of not greater than 120 μm and not less than 300 μm.

A preheating device 12 and a pocket portion forming device 13 are provided downstream of the film roll of the container film 3. The preheating device 12 corresponds to the preheating unit, and the pocket portion forming device 13 corresponds to the pocket portion forming unit according to one or more embodiments.

Figure 4:
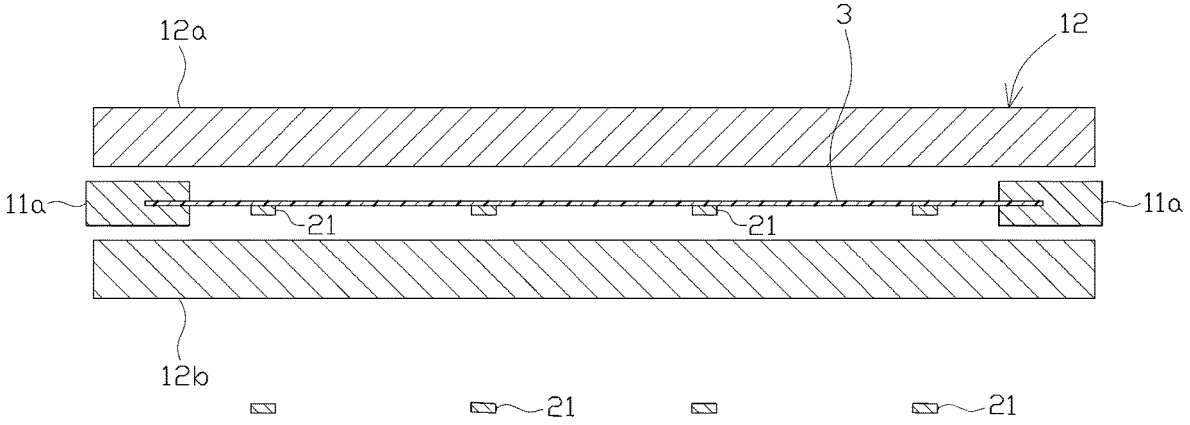
FIG. 4 is a sectional end view illustrating a preheating device and its periphery.

As shown in FIG. 4, the preheating device 12 includes an upper mold 12*a* and a lower mold 12*b* respectively placed on an upper side and a lower side across the container film 3 and is configured to heat at least pocket portion-forming areas of the container film 3 where the pocket portions 2 are to be formed. According to one or more embodiments, a preheating temperature of the container film 3 by the preheating device 12 is a relatively high temperature (for example, a melting point of the container film 3 or higher), in order to prevent shrinkage deformation of the container film 3 (especially the pocket portion 2) in the process of heat treatment such as retort sterilization of the blister packs 1. The "melting point of the container film 3 or higher) herein means not lower than a melting point of a single material when the container film 3 is made of the single material, and means not lower than a melting point of at least one thermoplastic resin material (other than an adhesive layer) out of multiple different thermoplastic resin materials when the container film 3 has a multi-layered structure made of the multiple different thermoplastic resin materials.

Figure 5:
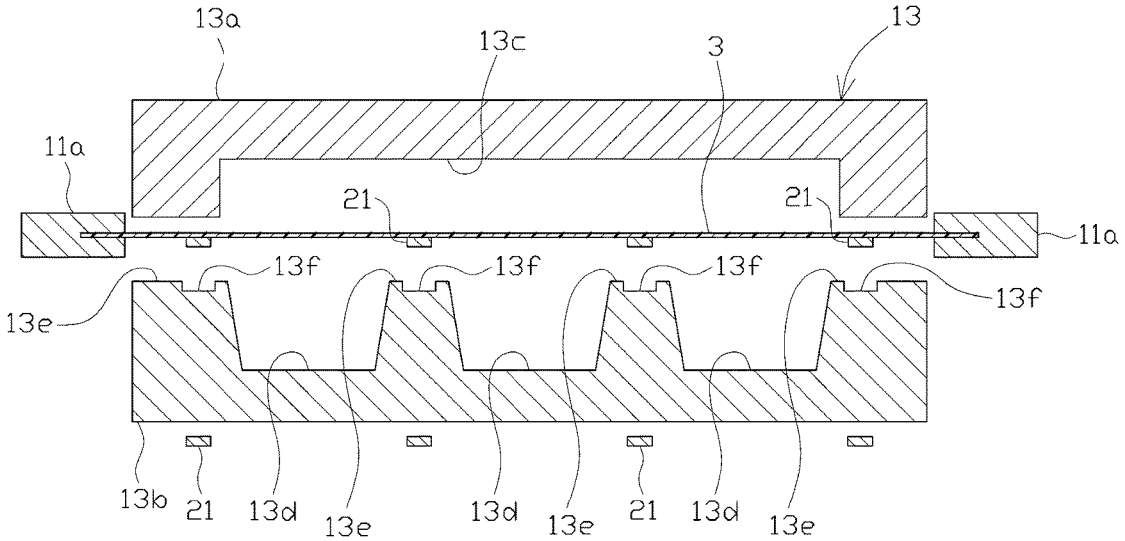
FIG. 5 is a sectional end view illustrating a pocket portion forming device and its periphery.

As shown in FIG. 5, the pocket portion forming device 13 includes an upper mold 13*a* and a lower mold 13*b* respectively placed on an upper side and a lower side across the container film 3. The lower mold 13 is configured to reciprocate in a vertical direction between an approach position to be close to the upper mold 13*a* and a retreat position to be away from the upper mold 13*a*.

The upper mold 13*a* is formed in a top-closed rectangular tubular shape and has an internal space 13*c* that is open downward. A predetermined gas (an inert gas, the air according to one or more embodiments) is suppliable from a non-illustrated gas supply device into the internal space 13*c*. The upper mold 13*a* is continuously water-cooled by a non-illustrated cooling water circulation device. According to one or more embodiments, the lower mold 13*b* is configured to be vertically movable. The upper mold 13*a* may also be configured to be vertically movable.

Figure 6:
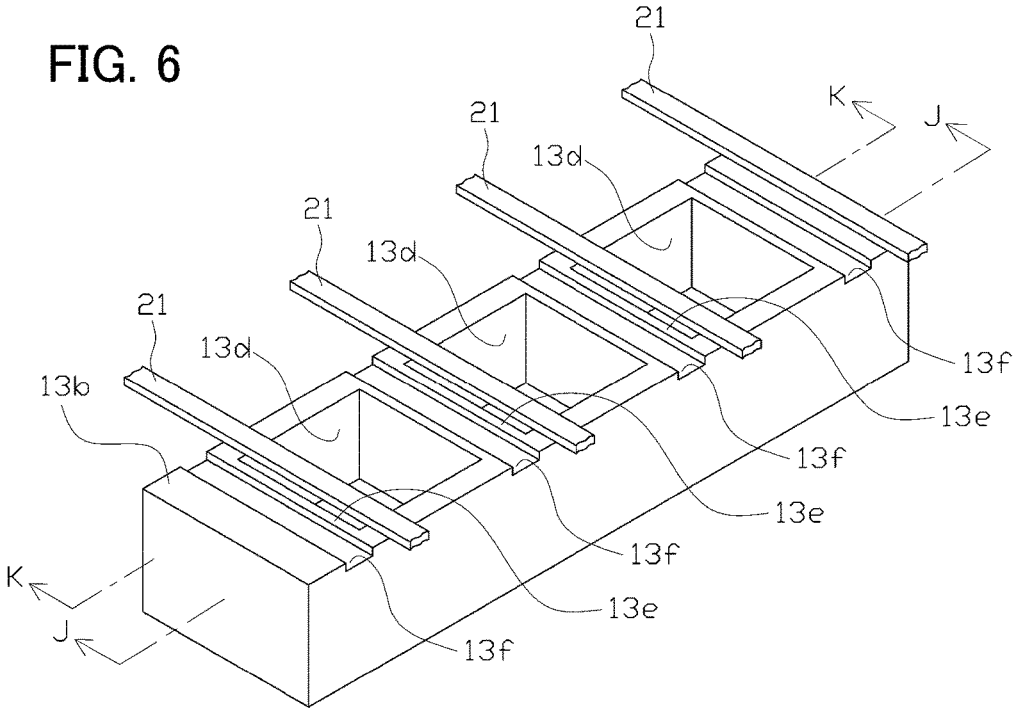
FIG. 6 is a schematic perspective view illustrating a lower mold of the pocket portion forming device and its periphery.

As shown in FIG. 5 and FIG. 6 (the container film 3 and the upper mold 13*a* are omitted from the illustration of FIG. 6), the lower mold 13*b* has a plurality of molding recesses 13*d* that correspond to the shape of the pocket portions 2 and that are arranged along the width direction of the container film 3. The molding recesses 13*d* of one or more embodiments have a relatively large depth (for example, 10 mm or larger). The lower mold 13*d* also has molding convexes 13*e* corresponding to part of the container film 3 that forms the flange portions 3*a* or that is regarded as scrap. A receiving recess 13*f* is formed in an upper portion of the molding convex 13*e*. The lower mold 13*b* is configured to be water-cooled, like the upper mold 13*a*.

The receiving recess 13*f* is a groove extended along a conveying direction of the container film 3. A plurality of the receiving recesses 13*f* are provided such that the molding recess 13*d* is placed therebetween in plan view. The depth of the receiving recess 13*f* is approximately equal to the thickness of a support belt 21 described later (for example, about 0.1 mm). An upper face of the molding convex 13*e* and an upper face of the support belt 21 are configured to be substantially flush with each other in the state that the support belt 21 is placed in the receiving recess 13*f*. In, for example, FIG. 5, the receiving recess 13*f* is illustrated to be deeper than an actual depth thereof, and the support belt 21 is illustrated to be thicker than an actual thickness thereof.

Figure 7:
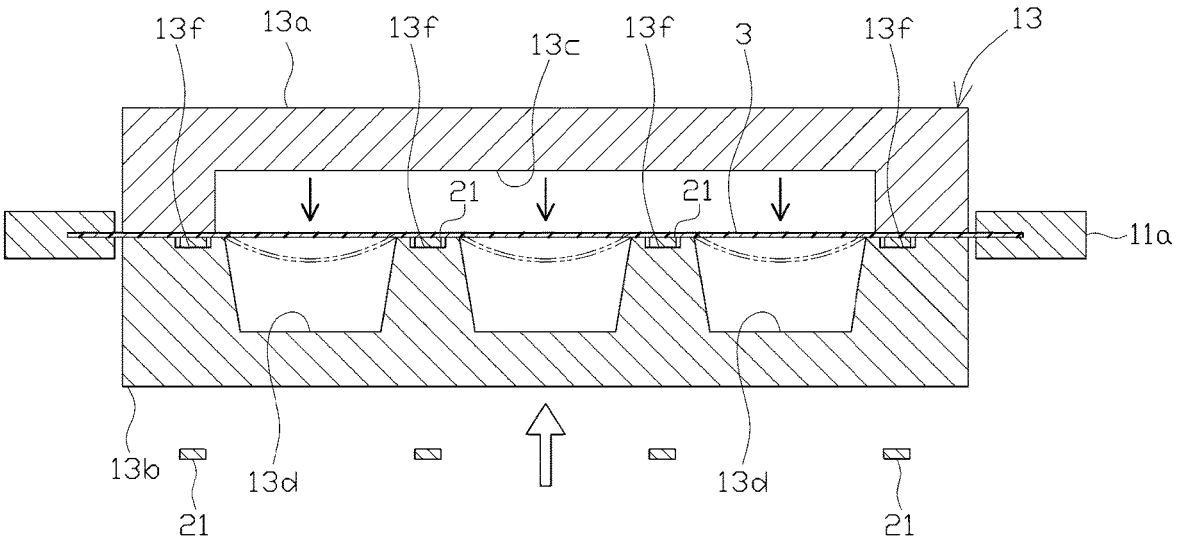
FIG. 7 is a sectional end view illustrating the state that a container film is placed between an upper mold and the lower mold, taken along a line J-J in FIG. 6.
Figure 8:
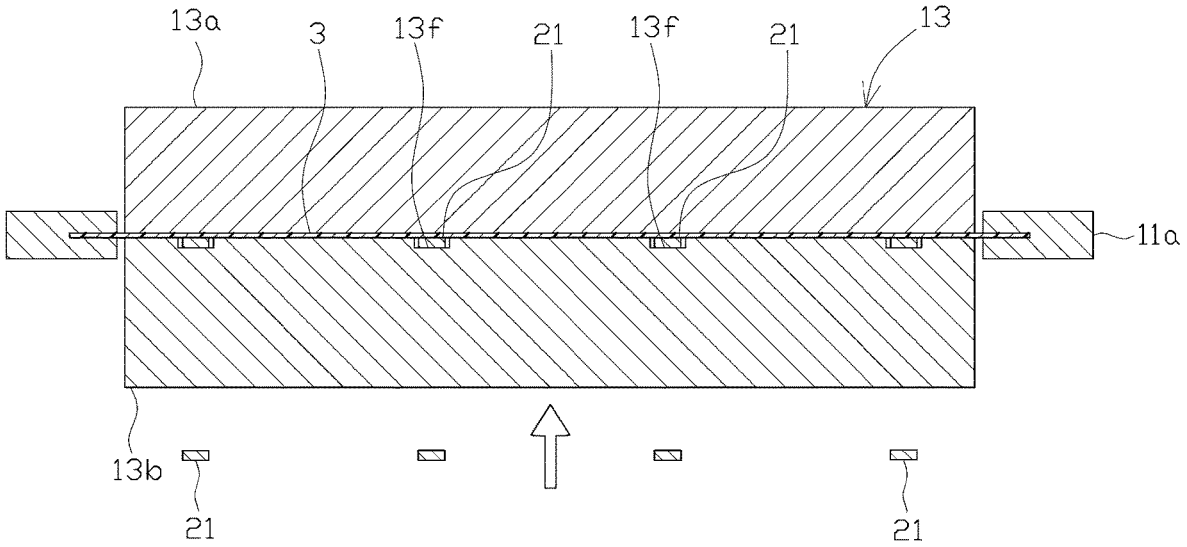
FIG. 8 is a sectional end view illustrating the state that the container film is placed between the upper mold and the lower mold, taken along a line K-K in FIG. 6.

The process of forming the pocket portions 2 moves the lower mold 13*b* from the retreat position to the approach position described above in the state that the container film 3 is heated to be softened by the preheating device 12, so that the container film 3 is placed between the upper mold 13*a* and the lower mold 13*b* (as shown in FIGS. 7 and 8). FIG. 7 is a sectional end view illustrating the state that the container film 3 is between the upper mold 13*a* and the lower mold 13*b*, taken along a line J-J in FIG. 6. FIG. 8 is a sectional end view illustrating the same state, taken along a line K-K in FIG. 6.

The process subsequently supplies the gas from the gas supply device into the internal space 13*c* of the upper mold 13*a*, so as to deform the container film 3 (the gas is shown by thick arrows and deformation of the container film 3 is shown by two-dot chain lines in FIG. 7). The process then presses the container film 3 against the molding recesses 13*d* of the lower mold 13*b*, so that a plurality of the pocket portions 2 are formed simultaneously in the container film 3. Accordingly, the pocket portions 2 are formed by a pressure forming method. Formation of the pocket portions 2 is performed during an interval between conveying operations of the container film 3. According to a modification, the upper mold 13*a* may be provided with small plugs in a shape substantially similar to the shape of the pocket portions 2. A modified process may protrude the plugs from the upper mold 13*a* prior to the supply of the gas into the internal space 13*c* to pre-form the outlines of the pocket portions 2 in the container film 3 and may subsequently supply the gas into the internal space 13*c*.

Referring back to FIG. 3, a filling device 14 serving as the filling unit to fill the pocket portions 2 with the content 5 is provided downstream of the pocket portion forming device 13. The filling device 14 opens a shutter (not shown) at predetermined intervals, for example, in synchronism with the conveying operations of the container film 3 to place predetermined amounts of the content 5 into the pocket portions 2.

A film roll of the cover film 4 in a belt-like form is on the other hand, wound in a roll and arranged separately from the container film 3. The cover film 4 pulled out of the film roll is guided to a receiving roller 15 provided downstream of the filling device 14. The cover film 4 guided to the receiving roller 15 is laid on the container film 3 such as to close the pocket portions 2.

A sealing device 16 is provided downstream of the receiving roller 15. The sealing device 16 includes an upper mold 16*a* having a lower face heated to a predetermined sealing temperature and a lower mold 16*b* having recesses formed corresponding to the pocket portions 2. Both the molds 16*a* and 16*b* are configured to be vertically moved and pressed against each other.

In the state that the container film 3 and the cover film 4 are fed in between the upper mold 16*a* and the lower mold 16*b*, both the films 3 and 4 are placed between the upper mold 16*a* having the heated lower face and the lower mold 16*b*. The cover film 4 is accordingly welded to the flange portions 3*a* of the container film 3. This manufactures the belt-like blister film 6 with the pocket portions 2 filled with the content 5.

A punching device 17 is provided downstream of the sealing device 16 to punch out the units of blister packs 1 from the blister film 6. The blister packs 1 punched out from the blister film 6 are transported to a non-illustrated finished product hopper by a conveyor 18. A non-illustrated cutting device is provided downstream of the punching device 17 to cut scraps remaining by punching-out. The scraps are cut into predetermined dimensions by the cutting device and are accumulated in a non-illustrated scrap hopper.

Furthermore, the blister packaging machine 10 includes support belts 21 and rails 23 (as shown in, for example, FIG. 9) serving as the separation unit, in addition to the respective devices described above.

The support belt 21 is a ring-shaped belt made of a thin-walled (for example, a thickness of 0.1 mm) heat resistant metal (for example, stainless steel) and has an outer circumferential face coated with a predetermined heat resistant resin (for example, a fluororesin). This coating is provided to cause the container film 3 to be readily separated from the support belts 21.

The plurality of support belts 21 are arranged at intervals along the width direction of the container film 3 (as shown in, for example, FIG. 4). The respective support belts 21 are wound around rolls 22*a* and 22*b* that are rotatable by a non-illustrated driving unit. The respective support belts 21 repeatedly move in a sequence of a forward pathway R1, a retreat pathway R2, a backward pathway R3, and an approach pathway R4, accompanied with the rotations of the rolls 22*a* and 22*b*.

Figure 9:
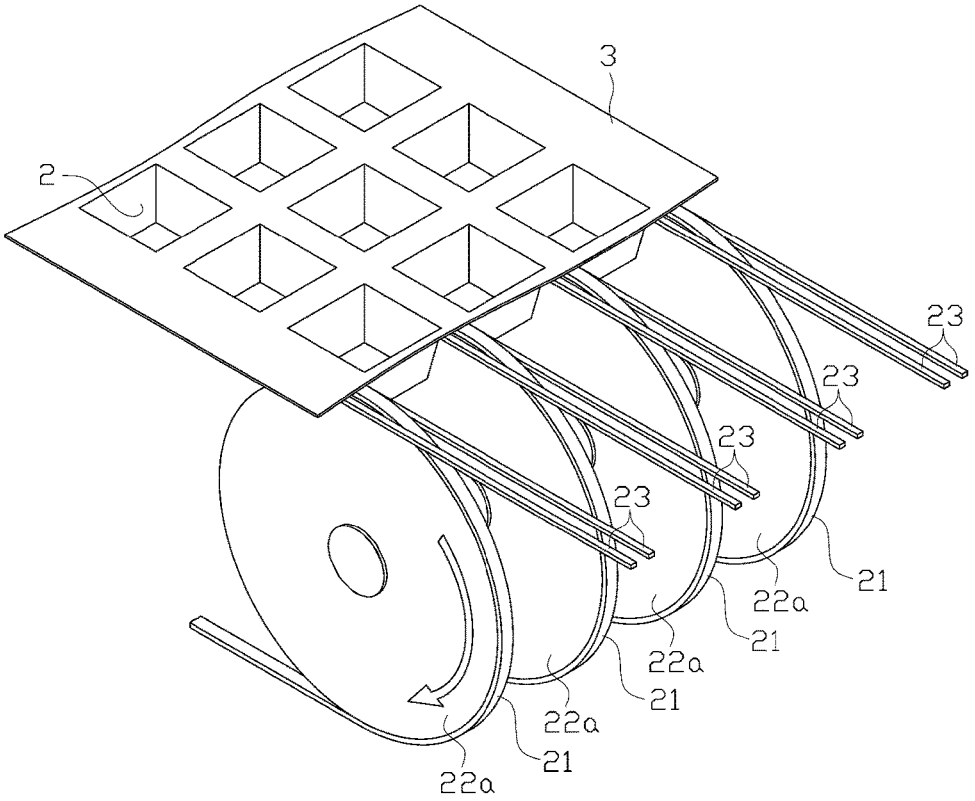
FIG. 9 is a schematic perspective view illustrating the container film, rails and their periphery.

The forward pathway R1 is a route substantially overlapping with a conveyance path of the container film 3 in a range from a position upstream of the preheating device 12 to a position downstream of the pocket portion forming device 13 and is located between the upper mold 12*a* and the lower mold 12*b* of the preheating device 12 and between the upper mold 13*a* and the lower mold 13*b* of the pocket portion forming device 13. The support belts 21 moving along the forward pathway R1 support part of the container film 3 other than the pocket portions 2 or part of the container film 3 other than pocket portion-forming areas where the pocket portions 2 are to be formed (in other words, part that forms the flange portions 3*a* or that is regarded as scrap) in a location from a position upstream of the preheating device 12 to a position downstream of the pocket portion forming device 13. More specifically, the support belts 21 support part of the container film 3 other than the pocket portion-forming areas where the pocket portions 2 are to be formed in a stage prior to formation of the pocket portions 2 (as shown in FIGS. 4 and 5) and support part of the container film 3 other than the pocket portions 2 in a stage after formation of the pocket portions 2 (as shown in FIG. 9).

Furthermore, the support belts 21 moving along the forward pathway R1 are moved in synchronism with the container film 3 that is the object to be supported and that is conveyed by the clip chain conveyor 11. Accordingly, the support belts 21 moving along the forward pathway R1 are moved in a direction identical with the conveying direction of the container film 3 at a speed identical with a conveying speed of the container film 3 during conveyance of the container film 3 and are temporarily stopped at a temporary stop of the container film 3. The support belts 21 are synchronously moved by controlling the rotating operations of the rolls 22*a* and 22*b* in conformity with the conveying operation of the container film 3 by a non-illustrated control unit.

Moreover, the support belts 21 moving along the forward pathway R1 are placed in the receiving recesses 13*f* of the lower mold 13*b* in the state that the lower mold 13*b* is moved up and the container film 3 is placed between the upper mold 13*a* and the lower mold 13*b* (as shown in FIGS. 7 and 8). The support belts 21 placed in the receiving recesses 13*f* are brought into contact with the lower mold 13*f* and cause the container film 3 to be placed between the support belts 21 and the upper mold 13*a*.

The retreat pathway R2 is a route that is located downstream of the pocket portion forming device 13 and that corresponds to an outer circumference of the roll 22*a* and is a route gradually going away from the container film 3 that is conveyed. The support belts 21 moving along the retreat pathway R2 gradually become away from the container film 3. As a result, this releases the support of the container film 3 by the support belts 21. One or more embodiments are configured to release the support of the container film 3 at a stage when the temperature of the container film 3 decreases to a sufficiently low temperature (for example, the melting point of the container film 3 or lower) by, for example, regulating a distance from the pocket portion forming device 13 to the retreat route R2 along the conveyance path of the container film 3.

The backward pathway R3 is a moving route of the support belts 21 when the support belts 21 are returned from the retreat route R2 to the approach route R4. According to one or more embodiments, the backward pathway R3 is located below the lower mold 12*b* of the preheating device 12 and below the lower mold 13*b* of the pocket portion forming device 13. This configuration suppresses the support belts 21 returning from the retreat pathway R2 to the approach pathway R4 from affecting the processing of the container film 3 by the preheating device 12 and the pocket portion forming device 13. Moreover, moving along the backward pathway R3 accelerates the heat radiation in the support belts 21 and more reliably prevents the support belts 21 from being overheated.

The approach pathway R4 is a route corresponding to an outer circumference of the roll 22*b* and is a route gradually approaching the container film 3 that is conveyed. The support belts 21 moving along the approach route R4 gradually approach the container film 3 and eventually support the container film 3.

Figure 10:
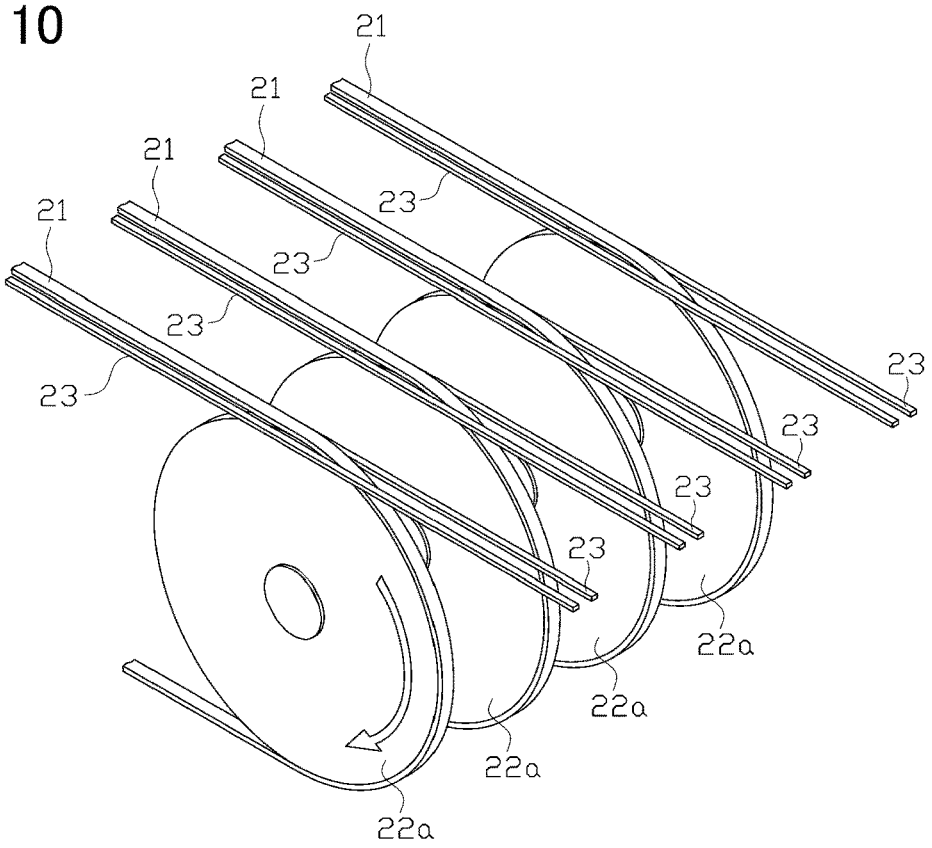
FIG. 10 is a schematic perspective view illustrating the rails and their periphery.

As shown in FIG. 9 and FIG. 10, the rails 23 have upper faces formed to be flat and are formed in a rod-like shape extended along the conveying direction of the container film 3. Only part of the container film 3 is illustrated in FIG. 9, and the container film 3 is omitted from the illustration of FIG. 10. The rails 23 are located slightly below the conveyance path of the container film 3 and are provided from a position downstream of the pocket portion forming device 13 to a position beyond a terminal end of the forward pathway R1. A plurality of the rails 23 are provided corresponding to the respective support belts 21. A pair of the rails 23 are placed at positions adjacent to each support belt 32 in plan view.

The rails 23 configured as described above come into contact with part of the container film 3 other than the pocket portion 2 in the case where the container film 3 is stuck to the support belt 21, while the support belts 21 supporting the container film 3 are moved along the retreat pathway R2. This configuration causes the container film 3 to be more reliably separated from the support belts 21.

Figure 12:
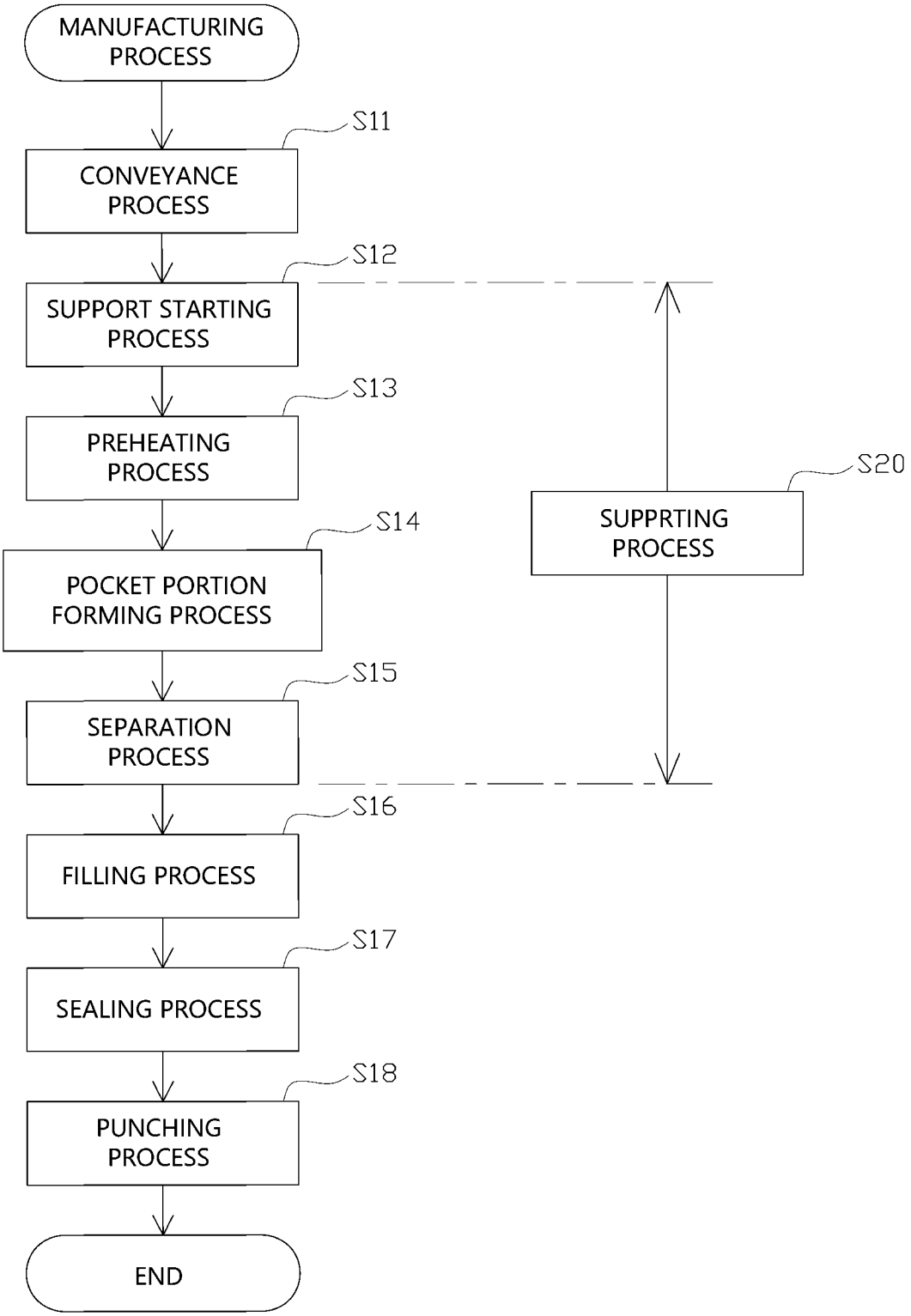
FIG. 12 is a flowchart showing a manufacturing process of the blister pack.

The following describes a manufacturing process of the blister packs 1 by using the blister packaging machine 10 described above. As shown in FIG. 12, in the manufacturing process of the blister packs 1, a conveyance process of step S11 is performed first to start conveying the container film 3 by the clip chain conveyor 11. This causes the container film 3 to be gradually conveyed from the film roll to downstream.

A support starting process of step S12 is performed subsequently to cause the support belts 21 reaching the forward pathway R1 to start supporting the container film 3. As a result, this starts a supporting process of step S20. The supporting process is a process of causing the container film 3 to be supported by the support belts 21.

A preheating process of step S13 is subsequently performed to cause at least the pocket portion-forming areas where the pocket portions 2 are to be formed in the container film 3 that is conveyed, to be heated by the preheating device 12. The container film 3 is heated in the state that the container film 3 is supported by the support belts 21.

A pocket portion forming process of step S14 is performed subsequently to move the lower mold 13*b* from the retreat position to the approach position described above, so that the support belts 21 are placed in the receiving recesses 13*f* and the container film 3 is placed between the upper mold 13*a* and the lower mold 13*b*. In this state, the support belts 21 are brought into contact with the lower mold 13*b*, and the container film 3 is placed between the upper mold 13*a* and the support belts 21. A gas is then supplied into the internal space 13*c* of the upper mold 13*a*, so that the container film 3 softened in the preheating process is pressed against the molding recesses 13*d* of the lower mold 13*b*. As a result, the pocket portions 2 are formed in the container film 3. After formation of the pocket portions 2, the lower mold 13*b* is moved to the retreat position described above not to interfere with moving of the container film 3 or the support belts 21.

A separation process of step S15 is then performed to move the support belts 21 supporting the container film 3 along the retreat pathway R2, so that the support belts 21 become away from the container film 3 to release the support of the container film 3 by the support belts 21. As a result, this terminates the supporting process of step S20. As described above, the supporting process of step S20 is continuously performed from the timing prior to the preheating process of step S13 to the timing after the pocket portion forming process S13 of step S14 according to one or more embodiments.

In the separation process, in the case where the container film 3 is stuck to the support belts 21, the container film 3 is brought into contact with the rails 23. Bringing the contact film 3 into contact with the rails 23 causes the container film 3 to be more reliably separated from the support belts 21. Accordingly, this more reliably releases the support of the container film 3 by the support belts 21.

A filling process of subsequent step S16 is performed to cause the pocket portions 2 to be filled with the content 5 by the filling device 14.

A sealing process of step S17 is subsequently performed to cause overlapping parts of the container film 3 and the cover film 4 to be placed between the upper mold 16*a* with the preheated lower face and the lower mold 16*b*. As a result, the cover film 4 is welded to the container film 3. This provides the blister film 6. After welding, the respective molds 16*a* and 16*b* are moved in a direction away from the container film 3 and returned to its original position.

A punching process of step S18 is performed last. The punching process causes the punching device 17 to punch out predetermined positions in the blister film 6 and thereby obtains the blister packs 1. The blister packs 1 thus obtained are subjected to heat treatment such as retort sterilization in a post process.

As described above in detail, one or more embodiments are configured to move the support belts 21 in synchronism with the container film 3 that is conveyed and thereby prevents a frictional force due to a difference between moving modes from being generated between the support belts 21 and the container film 3. This configuration thus enables the container film 3 to be supported with minimizing the load applied to the container film 3 and thereby more reliably prevents the container film 3 from being damaged or deformed.

Moreover, the container film 3 is supported by the support belts 21 in a location from the preheating device 12 to a position downstream of the pocket portion forming device 13, i.e., in a location where the container film 3 is especially likely to sag by preheating. Even when the preheating temperature of the container film 3 is a high temperature to be suitable for heat treatment like one or more embodiments, this configuration effectively suppresses the container film 3 from sagging. Accordingly, this more reliably prevents the occurrence of a trouble caused by a significant sag of the container film 3.

Furthermore, the support belts 21 serve to support part of the container film 3 other than the pocket portions 2 or part of the container film 3 other than the pocket portion-forming areas where the pocket portions 2 are to be formed. This configuration accordingly suppresses the support belts 21 from affecting the shape of the pocket portions 2 and thereby enhances the quality with regard to the pocket portions 2.

Additionally, when the lower mold 13*b* of the pocket portion forming device 13 is moved up, the support belts 21 are placed in the receiving recesses 13*f* provided in the lower mold 13*b*. This configuration accordingly enables the process of forming the pocket portions 2 in the container film 3 to be performed without being affected by the support belts 21 and thereby further ensures the good quality of the pocket portions 2.

Moreover, when the lower mold 13*b* of the pocket portion forming device 13 is moved up, the support belts 21 are brought into contact with the lower mold 13*b* and cause the container film 3 to be placed between the support belts 21 and the upper mold 13*a*. This configuration accordingly enables the heat of the support belts 21 to be more reliably transferred to the lower mold 13*b* and the upper mold 13*a* and thereby efficiently cools down the support belts 21. This configuration thus enables the part of the container film 3 supported by the support belts 21 to be effectively cooled down and sufficiently solidified. Accordingly, this more reliably prevents the container film 3 from being deformed or damaged in the event of release of the support of the container film 3 by the support belts 21. As a result, this furthermore ensures the good quality of the blister packs 1.

Furthermore, when the support belts 21 are moved along the retreat pathway R2, the container film 3 supported by the support belts 21 is brought into contact with the rails 23. This enables the container film 3 to be more reliably separated from the support belts 21. The rails 23 also effectively prevent the container film 3 from being deviated from its expected conveyance path and being excessively pulled toward the moving path of the support belts 21 and thereby more reliably prevent the container film 3 from being deformed or damaged.

Additionally, one or more embodiments use the wide container film 3 that enables a plurality of the pocket portions 2 to be formed along the width direction. This enables the plurality of pocket portions 2 to be formed simultaneously and enhances the production efficiency. One or more embodiments also use the container film 3 having the thickness of not greater than 300 μm prior to preheating. This reduces the material cost in manufacture of the blister packs 1. Furthermore, using the thin container film 3 enables the content 5 to be more quickly and more reliably heated in the process of heat treatment such as retort sterilization of the blister packs 1.

In the case of using the wide container film 3 that has the thickness of not greater than 300 μm prior to preheating and that enables a plurality of pocket portions to be formed along the width direction, on the other hand, the container film 3 is more likely to significantly sag by preheating. The support belts 21, however, serve to suppress the container film 3 from sagging. Even in the case of using such a container film 3, the configuration of one or more embodiments thus more reliably prevents the occurrence of a trouble caused by a sag of the container film 3.

The present disclosure is not limited to the description of the above embodiments but may be implemented, for example, by configurations described below. The present disclosure may also be naturally implemented by applications and modifications other than those illustrated below.

(a) According to the embodiments described above, the preheating device 12 and the pocket portion forming device 13 are provided separately. These components may, however, be integrated with each other. More specifically, a preheating forming device having the function of preheating the container film 3 and the function of forming the pocket portions 2 may be provided in place of the preheating device 12 and the pocket portion forming device 13. In this case, the preheating unit and the pocket portion forming unit are configured by the preheating forming device.

(b) A modification may be configured to cause the container film 3 to be preheated in a stepwise manner by the preheating device 12. This modification may further be configured to start the support of the container film 3 by the support belts 21 at a stage in the middle of preheating.

(c) According to the embodiments described above, the pocket portions 2 are formed by the pressure forming method. A modification may be configured to form the pocket portions 2 by vacuum forming method or any other forming method.

According to the embodiments described above, the pocket portion forming device 13 is configured to form one line of pocket portions 2 arrayed in the width direction of the container film 3. According to a modification, the pocket portion forming device 13 may be configured to form multiple lines of pocket portions 2 simultaneously.

(d) According to the embodiments described above, the blister pack 1 is configured to have one pocket portion 2. The number of the pocket portions 2 provided in the blister pack 1 is, however, not limited to the above embodiments, but the blister pack 1 employed may have any number of pocket portions 2. In other words, the technical concept of the present disclosure may be applied to a blister pack having a plurality of pocket portions 2 and a manufacturing method of such a blister pack. The shape of the pocket portion 2 may also be changed, altered or modified appropriately.

Furthermore, according to the embodiments described above, the blister film 6 is configured to have a plurality of pocket portions 2 along the width direction thereof. This configuration is, however, not essential. According to a modification, the blister film 6 may be configured to have only one pocket portion 2 along the width direction thereof.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 . . . blister pack, 2 . . . pocket portion, 3 . . . container film, 4 . . . cover film, 5 . . . content, 10 . . . blister packaging machine, 11 . . . clip chain conveyor (conveying unit), 12 . . . preheating device (preheating unit), 13 . . . pocket portion forming device (pocket portion forming unit), 13*a* . . . upper mold, 13*b* . . . lower mold, 13*f* . . . receiving recess, 21 . . . support belt, 23 . . . rail (separation unit), R2 . . . retreat pathway

What is claimed is:

1. A blister packaging machine that manufactures a blister pack including a pocket portion formed in a container film of a belt-like shape and a cover film that closes the pocket portion, the blister packaging machine comprising:

a conveyor that conveys the container film;

a preheater that preheats the container film conveyed by the conveyor;

a pocket portion former that forms the pocket portion in the container film softened by the preheater; and a support belt that moves in synchronism with the container film conveyed by the conveyor while supporting a part of the container film other than the pocket portion or a part of the container film other than an area where the pocket portion is to be formed, in at least a location from the preheater to a position downstream of the pocket portion former.

2. The blister packaging machine according to claim 1, wherein the pocket portion former includes a lower mold that moves up and down and that has a receiving recess extended along a conveying direction of the container film, and the support belt locates in the receiving recess in a state that the lower mold moves up.

3. The blister packaging machine according to claim 2, wherein the pocket portion former further includes an upper mold that locates above the lower mold, and the support belt contacts the lower mold and holds the container film between the support belt and the upper mold, in the state that the lower mold moves up.

4. The blister packaging machine according to claim 1, wherein the support belt moves along a retreat pathway that gradually becomes away from a conveyance path of the container film, in downstream of the pocket portion former, the blister packaging machine further comprising:

a separator that contacts the part of the container film other than the pocket portion and separates the container film from the support belt, when the support belt supporting the container film moves along the retreat pathway.

5. The blister packaging machine according to claim 2, wherein the support belt moves along a retreat pathway that gradually becomes away from a conveyance path of the container film, in downstream of the pocket portion former, the blister packaging machine further comprising:

a separator that contacts the part of the container film other than the pocket portion and separates the container film from the support belt, when the support belt supporting the container film moves along the retreat pathway.

6. The blister packaging machine according to claim 3, wherein the support belt moves along a retreat pathway that gradually becomes away from a conveyance path of the container film, in downstream of the pocket portion former, the blister packaging machine further comprising:

a separator that contacts the part of the container film other than the pocket portion and separates the container film from the support belt, when the support belt supporting the container film moves along the retreat pathway.

7. The blister packaging machine according to claim 1, wherein the container film has a plurality of pocket portions including the pocket portion along a width direction of the container film.

8. The blister packaging machine according to claim 2, wherein the container film has a plurality of pocket portions including the pocket portion along a width direction of the container film.

9. The blister packaging machine according to claim 3, wherein the container film has a plurality of pocket portions including the pocket portion along a width direction of the container film.

10. A method of manufacturing a blister pack including a pocket portion formed in a container film of a belt-like shape and a cover film that closes the pocket portion, the method comprising:

conveying the container film;

preheating the container film conveyed in the conveying;

forming the pocket portion in the container film softened in the preheating; and supporting a part of the container film other than the pocket portion or a part of the container film other than an area where the pocket portion is to be formed, by using a support belt that moves in synchronism with the conveyed container film, during at least an interval from the preheating to completion of the forming.

11. The method of manufacturing the blister pack according to claim 10, further comprising:

using a lower mold that moves up and down and has a receiving recess extended along a conveying direction of the container film, wherein the forming includes forming the pocket portion in a state that the lower mold moves up to place the support belt in the receiving recess.

12. The method of manufacturing the blister pack according to claim 11, wherein in the forming, the support belt contacts the lower mold and holds the container film between the support belt and an upper mold locating above the lower mold, in the state that the lower mold moves up.

13. The method of manufacturing the blister pack according to claim 10, further comprising:

separating the container film from the support belt by, after the forming, moving the support belt supporting the container film along a retreat pathway and making the part of the container film other than the pocket portion contact a predetermined separator, wherein the retreat pathway gradually becomes away from a conveyance path of the container film.

14. The method of manufacturing the blister pack according to claim 11, further comprising:

separating the container film from the support belt by, after the forming, moving the support belt supporting the container film along a retreat pathway and making the part of the container film other than the pocket portion contact a predetermined separator, wherein the retreat pathway gradually becomes away from a conveyance path of the container film.

15. The method of manufacturing the blister pack according to claim 12, further comprising:

separating the container film from the support belt by, after the forming, moving the support belt supporting the container film along a retreat pathway and making the part of the container film other than the pocket portion contact a predetermined separator, wherein the retreat pathway gradually becomes away from a conveyance path of the container film.

16. The method of manufacturing the blister pack according to claim 10, wherein the container film has a plurality of pocket portions including the pocket portion along a width direction of the container film.

17. The method of manufacturing the blister pack according to claim 11, wherein the container film has a plurality of pocket portions including the pocket portion along a width direction of the container film.

18. The method of manufacturing the blister pack according to claim 12, wherein the container film has a plurality of pocket portions including the pocket portion along a width direction of the container film.

19. The method of manufacturing the blister pack according to claim 10, wherein the container film prior to the preheating has a thickness of not greater than 300 μm.

20. The method of manufacturing the blister pack according to claim 11, wherein the container film prior to the preheating has a thickness of not greater than 300 μm.

21. The method of manufacturing the blister pack according to claim 12, wherein the container film prior to the preheating has a thickness of not greater than 300 μm.

* * * * *